US006930650B2

(12) United States Patent
Göttl

(10) Patent No.: US 6,930,650 B2
(45) Date of Patent: Aug. 16, 2005

(54) DUAL-POLARIZED RADIATING ASSEMBLY

(75) Inventor: Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/433,574

(22) PCT Filed: Jan. 23, 2003

(86) PCT No.: PCT/EP03/00703

§ 371 (c)(1),
(2), (4) Date: Jul. 3, 2003

(87) PCT Pub. No.: WO03/065505

PCT Pub. Date: Aug. 7, 2003

(65) Prior Publication Data

US 2004/0140942 A1 Jul. 22, 2004

(30) Foreign Application Priority Data

Jan. 31, 2002 (DE) ..... 102 03 873

(51) Int. Cl.[7] ..... H01Q 21/08
(52) U.S. Cl. ..... 343/810; 343/817
(58) Field of Search ..... 343/700 MS, 797, 343/795, 803, 110, 789, 817

(56) References Cited

U.S. PATENT DOCUMENTS

| | | | | |
|---|---|---|---|---|
| 3,740,754 A | * | 6/1973 | Epis | 343/797 |
| 4,015,264 A | | 3/1977 | Koerner | 343/725 |
| 4,218,685 A | | 8/1980 | Ellis, Jr. et al. | 343/727 |
| 5,173,715 A | * | 12/1992 | Rodal et al. | 343/795 |
| 5,481,272 A | * | 1/1996 | Yarsunas | 343/797 |
| 6,025,812 A | * | 2/2000 | Gabriel et al. | 343/797 |
| 6,333,720 B1 | | 12/2001 | Göttl et al. | 343/810 |
| 6,618,016 B1 | * | 9/2003 | Hannan et al. | 343/705 |

FOREIGN PATENT DOCUMENTS

| | | |
|---|---|---|
| DE | 197 22 742 A1 | 12/1998 |
| DE | 198 29 714 A1 | 1/1999 |
| DE | 198 23 749 A1 | 12/1999 |
| DE | 198 60 121 A1 | 7/2000 |
| WO | 99/62139 | 12/1999 |
| WO | 00/01032 | 1/2000 |

OTHER PUBLICATIONS

A.J. Sangster et al., "Dual–polarised stripline fed slot antenna incorporating signal cancellation," IEE Proceedings: Microwaves, Antennas and Progagation, vol. 148, No. 6, Dec. 2001.

Maci, S. et al; "Dual–Frequency Patch Antennas"; IEEE Antennas and Propagation Magazine, vol. 39, No. 6, Dec. 1997, pp. 13–20.

Kuga, N. et al; "A Notch–Wire Composite Antenna for Polarisation Diversity Rceptions"; IEEE Transactions on Antennas and Propagation, vol. 46, No. 6, Jun. 1998, pp. 902–906.

O. Zinke, H. Brunswig,; "Hochfrequenztechnik 1"; 134–137.

* cited by examiner

*Primary Examiner*—Tho Phan
(74) *Attorney, Agent, or Firm*—Nixon & Vanderhye P.C.

(57) ABSTRACT

An improved dual-polarized antenna arrangement has four antenna element devices each with a conductive structure between opposite antenna element ends. Those antenna element ends of two adjacent antenna element devices adjacent to one another are, in each case, isolated from one another for radio frequency purposes. Those antenna element ends of two adjacent antenna element devices located adjacent to one another in pairs form feed points, and the antenna element devices are fed at least approximately in phase and approximately symmetrically between the respective opposite feed points.

31 Claims, 12 Drawing Sheets

DUAL-POLARIZED RADIATING ASSEMBLY

This application is the U.S. national phase of international application PCT/EP03/00703 filed 23 Jan. 2003, which designated the U.S.

FIELD

The technology herein relates to a dual-polarized antenna element arrangement, in particular for the field of mobile radio.

BACKGROUND AND SUMMARY

Dual-polarized antennas in the field of mobile radio are preferably used at 800–1000 MHz and 1700–2200 MHz. In this case, an antenna produces two orthogonal polarizations, and, in particular, the use of two linear polarizations aligned at +45° and −45° with respect to the vertical has been proven (X polarization). In order to optimize the illumination of the supply area, antennas with different horizontal 3 dB beam widths are used with 3 dB beam widths of 65° and 90° having been implemented.

For antennas with only one polarization, there are a number of solutions in the prior art for providing these different 3 dB beam widths.

Thus, for example, simple vertically aligned dipoles with a reflector that is optimized for the appropriate 3 dB beam width are used as vertically polarized antennas. For antennas for only one operating frequency band, solutions for X-polarized antennas with 3 dB beam widths of 90° have likewise already become known. Cruciform dipoles, dipole squares or patch antenna elements with an appropriately designed reflector are used, by way of example, for this purpose, in order to achieve an appropriate horizontal 3 dB beam width.

According to DE 197 22 742 A1, a reflector geometry is proposed for this purpose in which slots are incorporated in the reflector side boundaries which project laterally beyond the reflector plate. If a reflector geometry such as this is used, for example, for cruciform dipoles or for a specific dipole structure such as that which is known by way of example from DE 198 60 121 A1, then a horizontal 3 dB beam width of between about 85° and 90° can be achieved. However, this example relates only to an antenna which is operated in only one operating frequency band.

However, in the case of dual-polarized antennas which are intended to be operated in two frequency bands that are well apart from one another and which are offset, for example, by a factor of 2:1 from one another, solutions are known only with horizontal 3 dB beam widths of about 65°.

By way of example, DE 198 23 749 in this context proposes a combination of dipole antenna elements, allowing a 3 dB beam width of about 65° to be achieved for the two frequency bands (for example the 900 MHz band and the 1800 MHz band).

A corresponding solution using patch antenna elements is known, for example, from WO 00/01032.

It has not yet generally been possible to produce antennas which can be operated in two frequency bands or in two operating frequency ranges and at the same time are intended to have a 3 dB beam width of about 90°.

Furthermore, reference is also made to further prior publications relating to antennas which, however, are likewise not suitable for operation with a 3 dB beam width of about 90° in two frequency bands that are offset with respect to one another. By way of example, these are antennas such as those described in the publication S. Maxi and Biffi Gentili: "Dual-Frequency Patch Antennas" in: IEEE Antennas and Propagation Magazine, Vol. 39, No. 6, December 1997. A dual-polarized antenna which has a triple structure and whose polarization is aligned horizontally and vertically is also known from Nobuhiro Kuga: "A Notch-Wire Composite Antenna for Polarization Diversity Reception" in IEEE AP Vol. 46, No. 6, June 1998 pages 902–906. This antenna produces an omnidirectional polar diagram. However, this does not relate to a dual-band antenna which has a horizontal 3 dB beam width of about 90°.

Exemplary illustrative non-limiting technology described herein provides an antenna element arrangement which, firstly, can be used for two orthogonal polarizations and in which at least one antenna element can be integrated for a higher frequency band range, with the aim of being able to achieve 3 dB beam widths of about 90°.

The dual-polarized antenna element arrangement according to exemplary illustrative non-limiting implementations make it possible to construct antennas which have horizontal 3 dB beam widths of 90° in both frequency bands. Independently of this, these antenna element structures may, however, also be used for operation in only one frequency band, if required.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
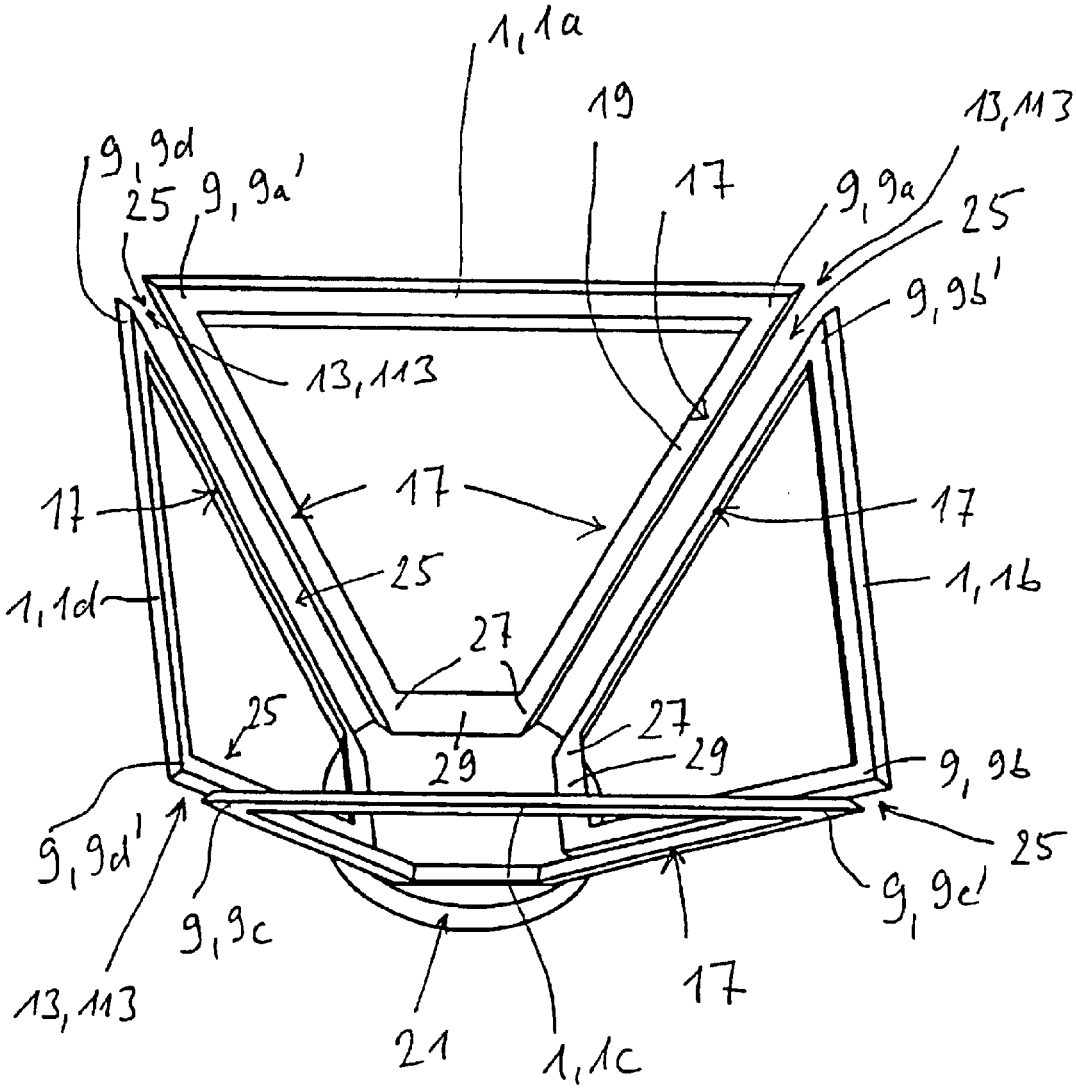
FIG. 1 shows a schematic perspective illustration of an exemplary non-limiting illustrative dual-polarized antenna element arrangement.
Figure 2:
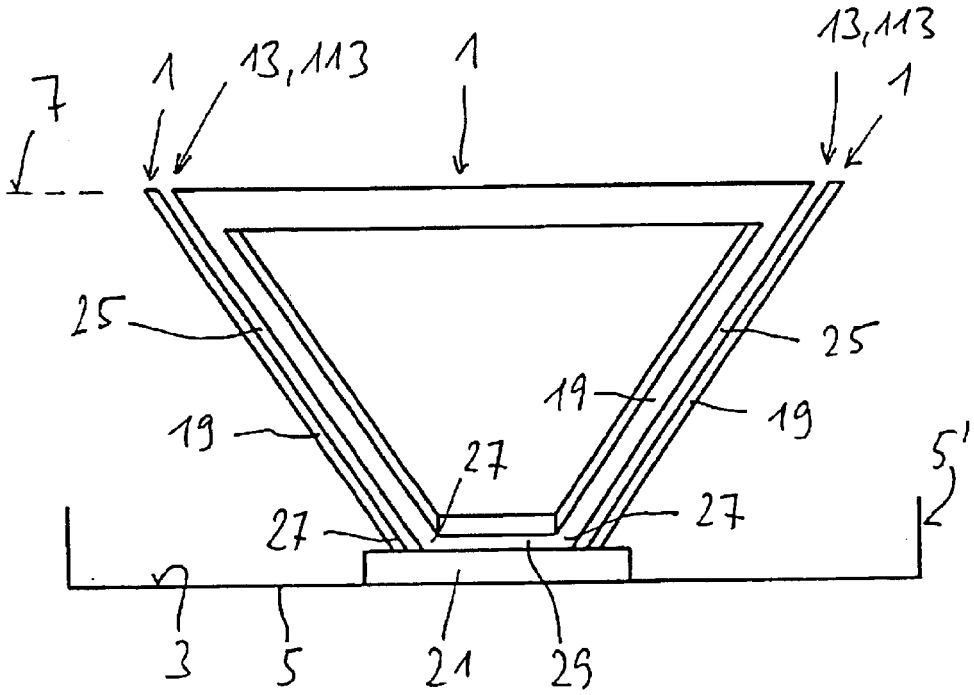
FIG. 2 shows a schematic side view of the antenna element arrangement illustrated in the form of a perspective illustration in FIG. 1, in the form of a cross section at right angles through the reflector plane.
Figure 3:
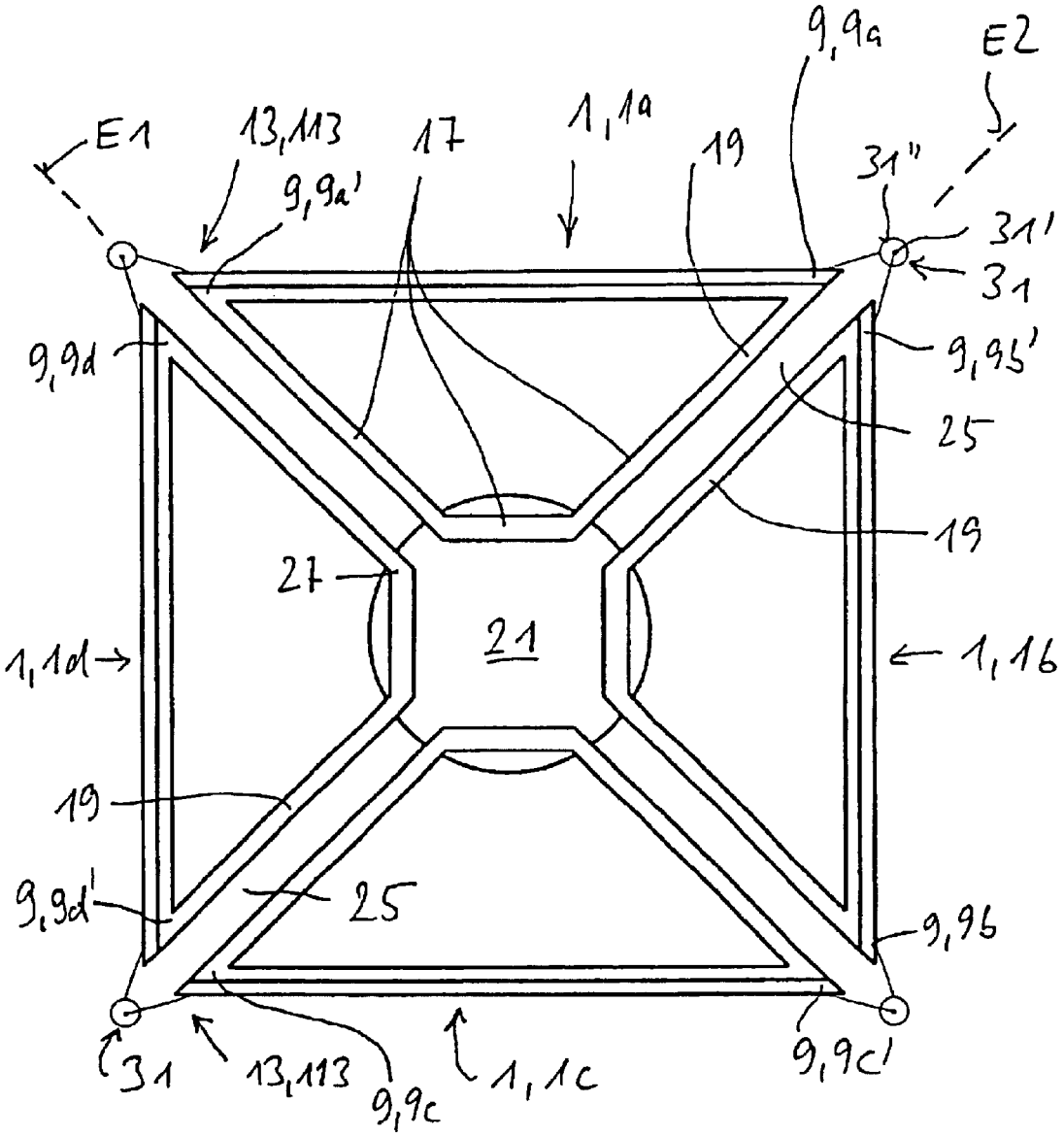
FIG. 3 shows a schematic plan view of the exemplary non-limiting illustrative arrangement shown in FIGS. 1 and 2.

FIGS. 1 to 3 show a first exemplary non-limiting illustrative implementation of a dual-polarized antenna.

As can be seen from the perspective illustration in FIG. 1, from the schematic side view in FIG. 2 (in the form of a sectional illustration at right angles through the reflector plane) and from a plan view in FIG. 3, the exemplary non-limiting illustrative antenna element arrangement essentially has four antenna element devices 1, that is to say four antenna element devices 1*a*, 1*b*, 1*c* and 1*d*, which are conductive. These four antenna element devices 1 form a structure whose plan view has a square shape. In other words, the antenna with the antenna element arrangement as explained is constructed to be rotationally symmetrical or point-symmetrical about 90°.

The antenna element devices 1 which form a square structure in a plan view may in this case also be referred to as antenna elements, antenna element arms, antenna element rods or, in general, as antenna element structures.

These four antenna element devices 1 which are in the form of rods in the illustrated exemplary arrangements shown in FIGS. 1 to 3 have approximately the same length, of about 0.2 times the operating wavelength λ to the operating wavelength λ itself. The distance from the plane 3 of the reflector 5 is approximately ⅛ to ¼ of the operating wavelength.

It is thus evident from the described exemplary configuration that the antenna element devices 1 which are in the form of rods in the described exemplary implementation are arranged in a common antenna element plane 7, parallel to the reflector plane. In this case, the respectively opposite antenna element devices 1 in the described exemplary implementation, the antenna element devices 1*a* and 1*c*, are parallel to one another. Furthermore, the two further antenna element devices which are each offset through 90°—so that in the described exemplary implementation the antenna element devices 1*b* and 1*d*, are likewise arranged parallel to one another. Both pairs of mutually parallel antenna element devices 1*a* and 1*c* on the one hand and 1*b* and 1*d* on the other hand are aligned at right angles to one another or at least approximately at right angles to one another, resulting in an antenna arrangement which can transmit and receive using two mutually perpendicular polarizations (to be precise in a plane E1 which is aligned at an angle of +45° to the horizontal, and in a plane E2 which is aligned at an angle of −45° to the horizontal).

As can likewise be seen from the exemplary non-limiting implementation, the respectively opposite ends 9 (i.e., the ends 9 which are remote from one another), of the four antenna element devices 1 (i.e., the antenna element ends 9*a*, 9*a*' and 9*b*, 9*b*', as well as 9*c*, 9*c*' and 9*d*, 9*d*') are isolated for radio frequency purposes from the respectively adjacent end point of the adjacent antenna element device. This means that:

- the antenna element end 9*a* is isolated from the adjacent antenna element end 9*b*',
- the antenna element end 9*b* is isolated from the adjacent antenna element end 9*c*',
- the antenna element end 9*c* is isolated from the adjacent antenna element end 9*d*' and
- the antenna element end 9*d* is isolated from the adjacent antenna element end 9*a*', for radio frequency purposes. Each of the four antenna element devices 1 is held and supported by an electrically conductive holding device 17, preferably with respect to the reflector 5. This holding device 17 in the exemplary non-limiting arrangements shown in FIG. 1 to 3 may in each case be formed from two rods or a rod device 19 for each antenna element device 1. The rods or rod device 19 are or is passed to the antenna element devices 1, in a diverging form to the antenna element ends 9, from a base 21 which is preferably formed by the reflector and to which they or it are or is mechanically mounted and fitted in an electrically conductive manner. The arrangement in this case comprises the rod devices 19 (which are in each case passed to the adjacent antenna element ends, for example to the antenna element ends 9*a* and 9*b*' of the antenna element devices 1*a* and 1*b* that are arranged adjacent to one another) running from their base 21 parallel and at a distance from one another, so that a slot or gap 25 is in each case formed between two adjacent rods or rod arrangements 19.

Firstly, as can be seen from the described configuration, the rods or rod device 19 are or is connected to one another at the reflector-side or base-side end 27 via a conductive base 21, the conductive reflector plate 5 and/or a conductive connection 29. As stated, a cable connection to the reflector 5 itself is additionally preferably produced in this case. This cable connection to the reflector 5 need not necessary be provided, however.

An approximately trapezoidal structure is thus formed in the case of the exemplary non-limiting arrangements explained with reference to FIGS. 1 to 3 by the respective antenna element device 1, the rod or holding device 17, 19 which leads to the respective antenna element ends of the antenna element device 1, and the base-side or reflector-side ends 27, as well as by the conductive connecting devices 29 which may be provided between them and/or a conductive base, or by the reflector 5 itself.

In this exemplary non-limiting implementation, the antenna element devices 1 are fed at the respective end of the four gaps or slots 25, that is to say at the antenna element ends 9. They are thus in this case fed at these four corners or points 13, preferably by means of coaxial cables 31 which are indicated schematically in the schematic plan view shown in FIG. 2.

In this case, each of the inner conductors 31' is electrically connected to one end of one antenna element device 1, and the outer conductor 31" is electrically connected to the adjacent end of the adjacent antenna element device 1. Thus, in other words, the outer conductor 31" of the coaxial cable 31 is, for example, electrically connected to the antenna element end 9*a* of the antenna element device 1*a* while, in contrast, the inner conductor 31' is electrically connected to the adjacent antenna element end 9*b'* of the adjacent antenna element device 1*b*.

Feed points 113 are thus in each case formed at the ends 9 (which are located adjacent to one another in pairs) of the antenna element devices 1, that is to say at the four points or corners 13 that have been mentioned, with the antenna element arrangement in each case being fed in phase at these feed points, that is to say at the respectively diametrically opposite points or corners at that end of the slots or gaps 25 which is remote from the reflector, that is to say at the feed points 113 which have been mentioned at the respective gap end. This may be done, for example, by connecting them together by means of a coaxial cable of equal length from a central feed point. This thus results in two central feed points 35*a* and 35*b* for each of the orthogonal polarizations which, at the same time, have a high degree of decoupling between them.

Since the rods or rod device 19 of the holding device 17 and hence the slots or gaps 25 have or has a length of $\lambda/4$, the antenna element ends 9 can be short-circuited without any problems at the base end or reflector end. In this example, they thus act as a balancing device, together with the feed cables.

The schematic cross-sectional illustration in FIG. 2 shows a cross section of the reflector which may have side boundary walls 5' which run externally, as well as transversely or at right angles to the reflector plane 3.

The following text refers to a next exemplary non-limiting illustrative arrangement described with reference to FIGS. 4 and 5. This exemplary arrangement differs from that shown in FIGS. 1 to 3 in that the surface which is bounded by the respective antenna element device 1 and by the rods or rod devices 19 (which act at the side on the ends of the antenna element devices 1) and by the base 21 to which the rods 19 are fitted, as well as, if appropriate, by the reflector 5 and/or by the conductive connecting elements 29 which have been mentioned, is not free or left empty but is configured as an electrically complete surface and hence as a closed surface. This thus results in four antenna element devices 1 or antenna element structures 1 which each have a closed surface element 39. The boundary edge 1' that is in each case located at the top of this surface element 39 represents the antenna element device 1, in a comparable way to the exemplary non-limiting illustrative arrangements shown in FIGS. 1 to 3. The side boundary edges 19' in the end represent the rods or rod device 19 which bound or bounds the associated slot or the associated gap 25. The edge 27' which is located at the bottom is comparable to the connecting element 28 on the base side or reflector side.

Figure 4:
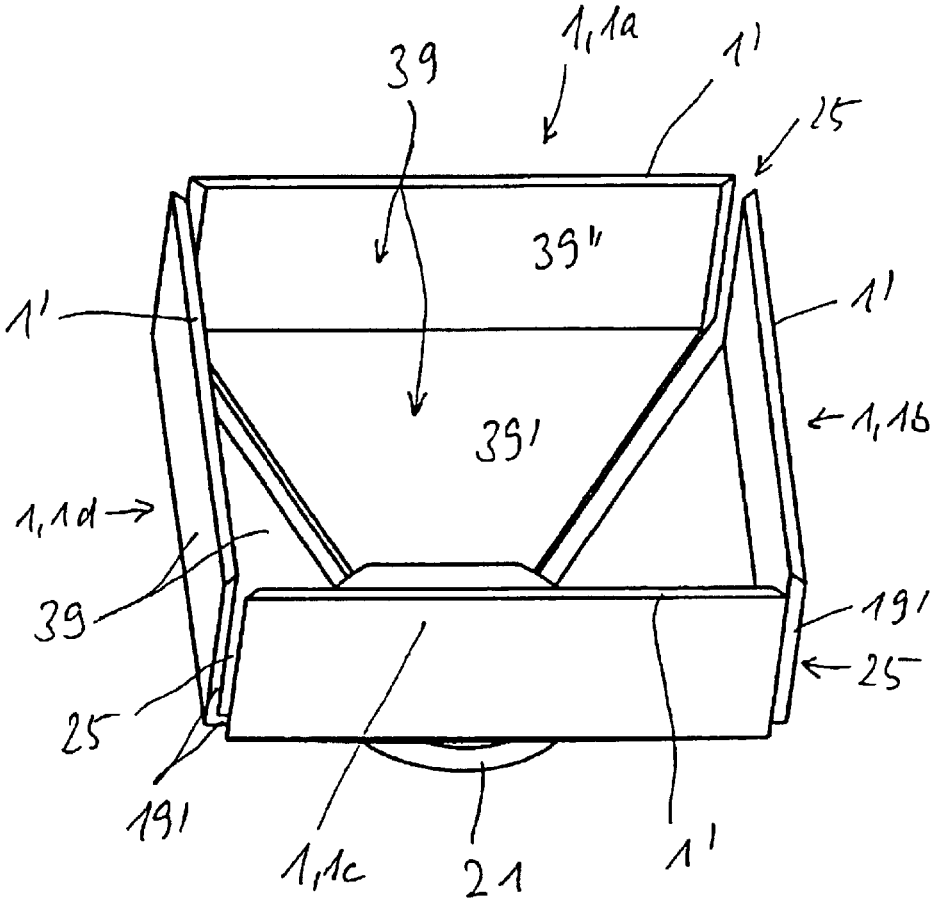
FIG. 4 shows a schematic perspective illustration of a modified exemplary non-limiting illustrative arrangement of an antenna element arrangement.
Figure 5:
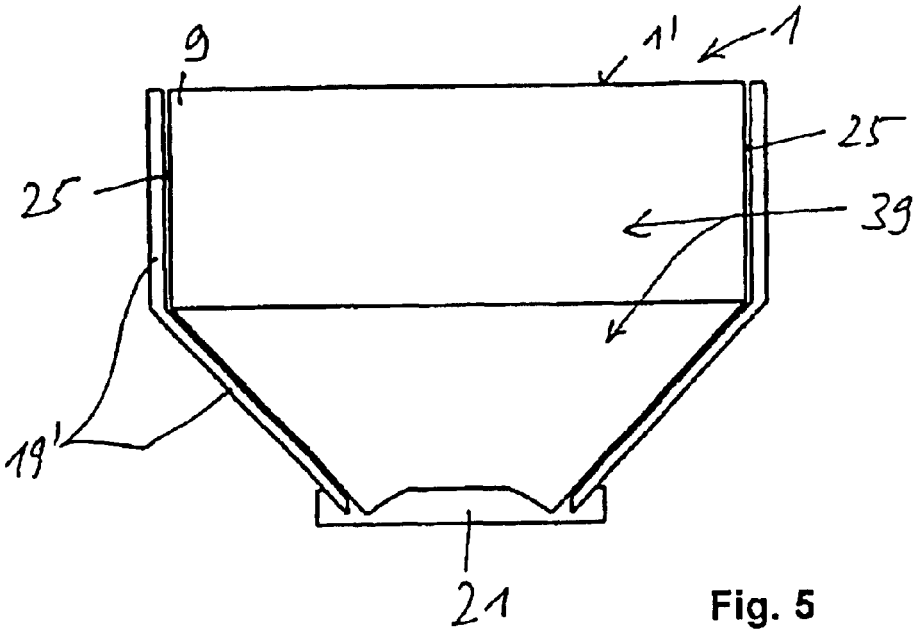
FIG. 5 shows a side view of the exemplary non-limiting illustrative arrangement shown in FIG. 4.
Figure 6:
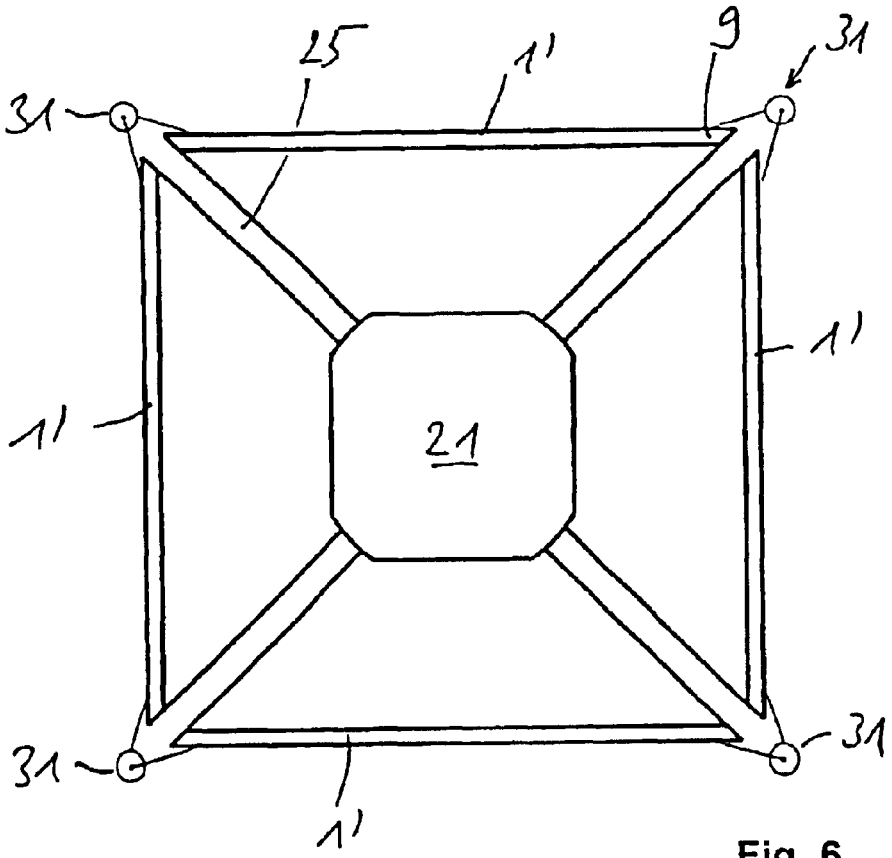
FIG. 6 shows a plan view of the exemplary non-limiting illustrative arrangement shown in FIGS. 4 and 5.

A further difference between the exemplary non-limiting illustrative arrangements shown in FIGS. 4 to 6 and that in the exemplary non-limiting illustrative arrangements shown in FIGS. 1 to 3 is that the surface elements 39 are positioned on edge in the vertical sectional illustration, the lower section 39', on the base side or reflector side, of the surface element runs in a slightly divergent manner outward starting from a central section (for example at an angle of 20° to 70°, preferably of 30° to 60° and in particular of 45°, while in contrast only one outer section 39", which is at a distance from the reflector, of the respective surface element 39 is aligned in the vertical direction, that is to say at right angles to the reflector 5. This makes it possible for the entire length of the slot or gap 25, and hence the entire length of boundary edges 19' which are comparable to the holding rod 19 shown in FIG. 1 likewise once again to be $\lambda/4$ of the operating frequency (preferably of the mid-operating frequency) so that the surface elements 39 can produce a short circuit on the base side or reflector side between the radiating boundary edges 19' which are located at the top and run parallel to the reflector, thus forming the actual antenna element devices 1. To this extent, the exemplary non-limiting illustrative arrangement shown in FIG. 2 also shows that the exemplary arrangement shown in FIG. 1 need not have rods or rod devices 19 running in a straight line but that, even in the case of the exemplary non-limiting illustrative arrangements shown in FIGS. 1 to 3, the rods or rod devices may, while having a parallel profile with respect to one another, have a kinked shape, comparable to the edge 19' in the exemplary non-limiting illustrative arrangements shown in FIGS. 3 to 5, forming a slot 25.

The overall height of an antenna element formed in this way is less due to this kinked configuration of the individual surface elements 39.

The exemplary non-limiting illustrative arrangement shown in FIGS. 4 to 6 may thus also be configured such that only rectangular surface elements 39" which are open at the top are provided, instead of the lower surface elements 39', which each form a trapezoidal shape when seen in a plan view, apertures, with the upper surface elements 39" then being held by side supporting elements 19.

Figure 7:
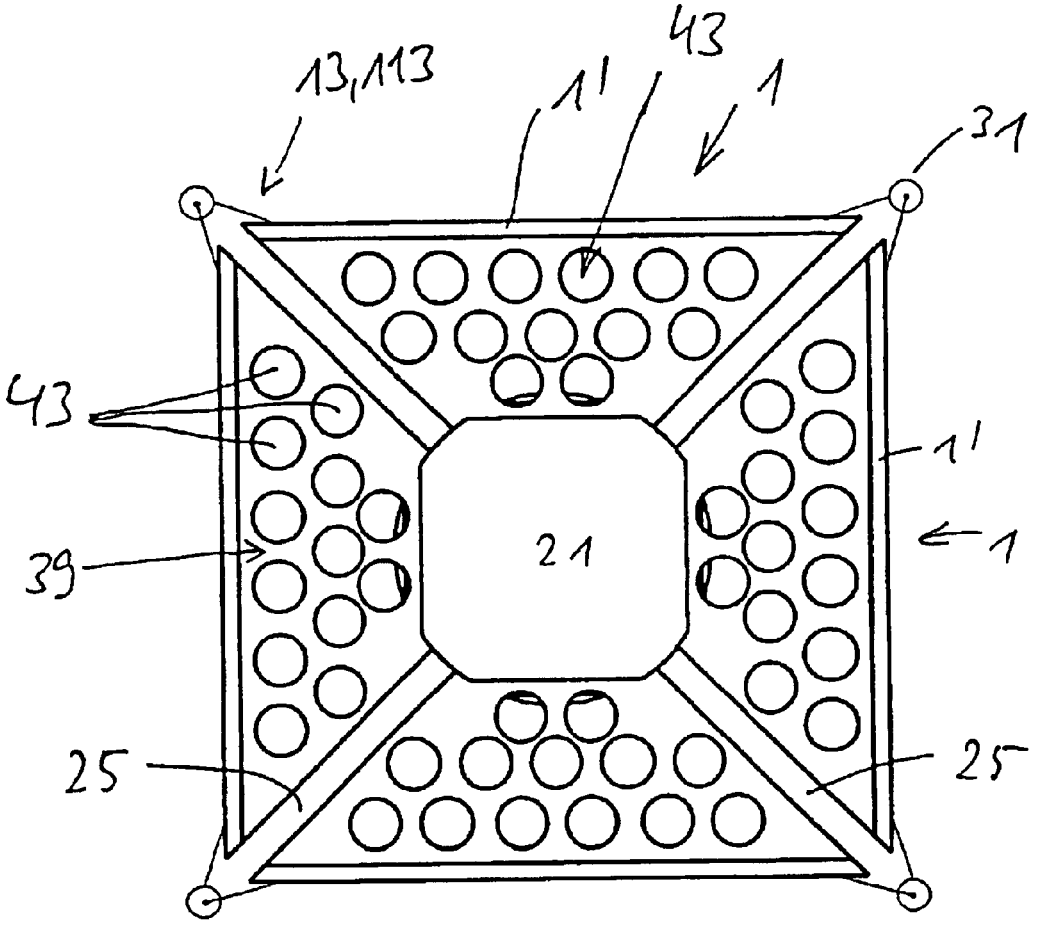
FIG. 7 shows a plan view, corresponding to FIG. 6, of a modified exemplary non-limiting illustrative arrangement with a hole grid as antenna element arrangements.

The schematic plan view shown in FIG. 7 illustrates only that the surface elements 39 need not be designed to be closed over the complete area, in contrast to the situation in the last-explained exemplary non-limiting illustrative arrangement, but may also, for example, be provided with a hole grid 43. Further modified forms are possible and feasible as required.

Figure 8:
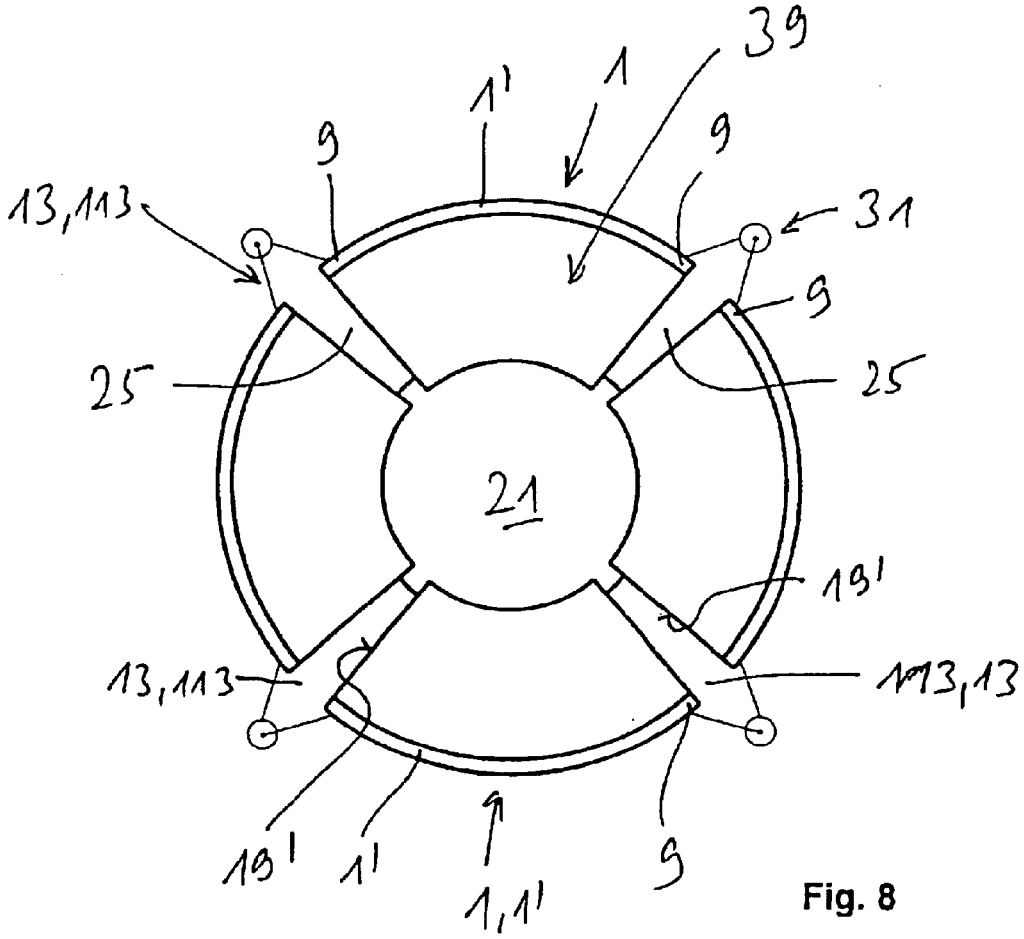
FIG. 8 shows a plan view of a further modified exemplary non-limiting illustrative implementation, with convex-shaped antenna element arrangements.

An overall structure in which the individual antenna element devices 1 are not in the form of rods or boundary edges running in straight lines but form convex or even partially circular antenna element devices 1 when seen in a plan view, was chosen for the exemplary non-limiting illustrative arrangement shown in FIG. 8. If the slots or gaps 25 that are located opposite one another in a cruciform manner were not bounded by holding rods or rod devices 19, but these edges 19' were part of surface elements 39 that were located offset through 90°, then these would likewise be configured running in a corresponding manner aligned in the form of partial truncated cones or partial cylinders.

Figure 9:
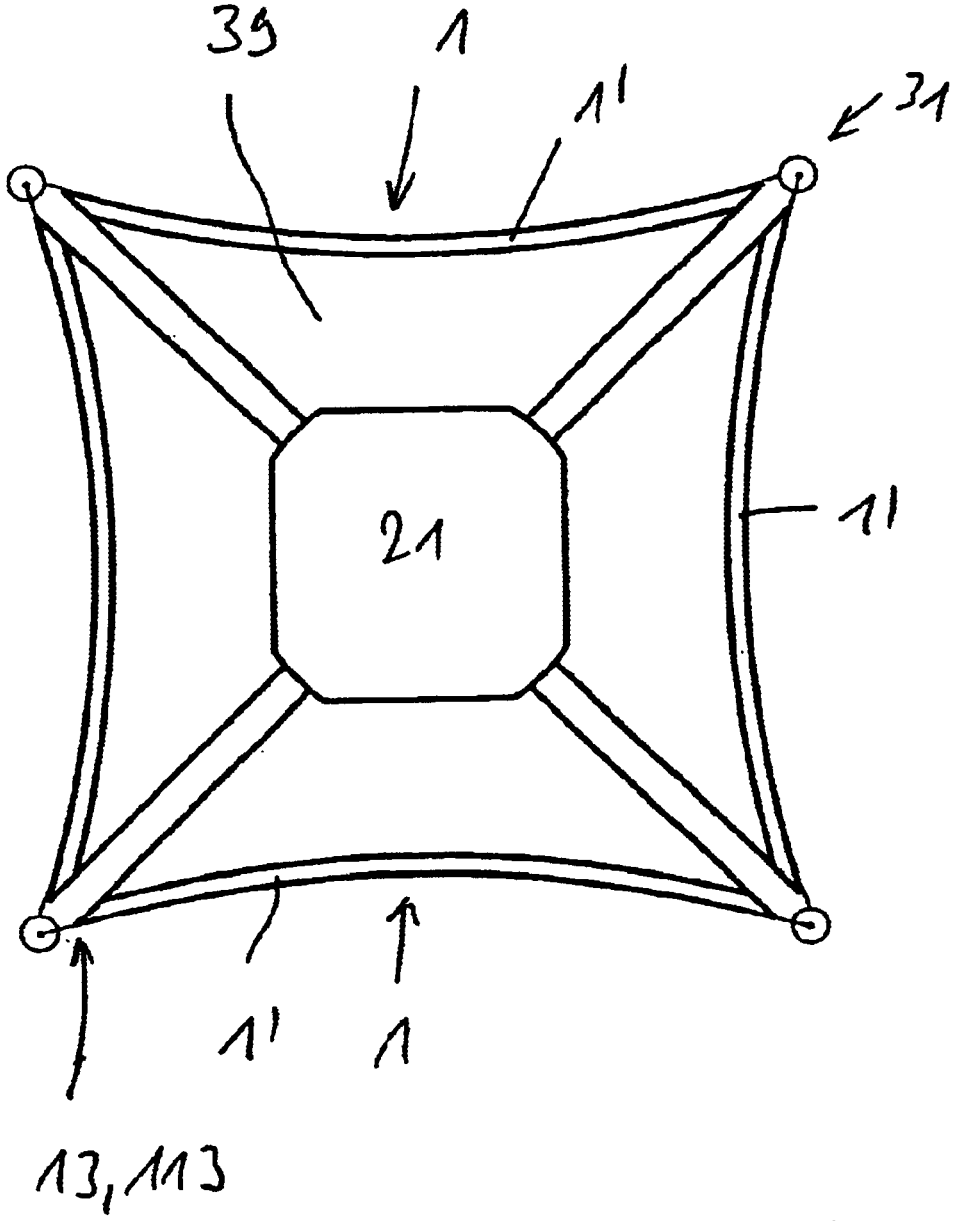
FIG. 9 shows a further modified exemplary non-limiting illustrative implementation, in the form of a schematic plan view, with concave-shaped antenna element arrangements.

In one exemplary non-limiting illustrative implementation, shown in FIG. 9, the antenna element devices 1 have a concave shape rather than a convex shape. In this exemplary implementation as well, the antenna element device 1 which is located at the top could otherwise once again be in the form of an electrically conductive device in the form of a rod or the like, held by corresponding rods or rod devices 19. The free surface in between may, however, once again be closed over the complete surface as well, so that surface elements 39 are formed, comparable to the exemplary non-limiting illustrative arrangements shown in FIGS. 4 and 5.

It can thus be seen in particular from FIGS. 8 and 9 that the antenna element devices 1, for example when using appropriate surface elements 39, may have the antenna element edges 1' which not only run in straight lines between the feed points 13, 113 but, when seen in a plan view from a central center section, are shaped such that the project outward in a convex shape or even in a concave shape. Appropriately shaped antenna element devices 1 may be used in this case, or alternatively full-area or partially full-area antenna elements 1 with surface sections 39, or forming a corresponding free space 39'.

Figure 10:
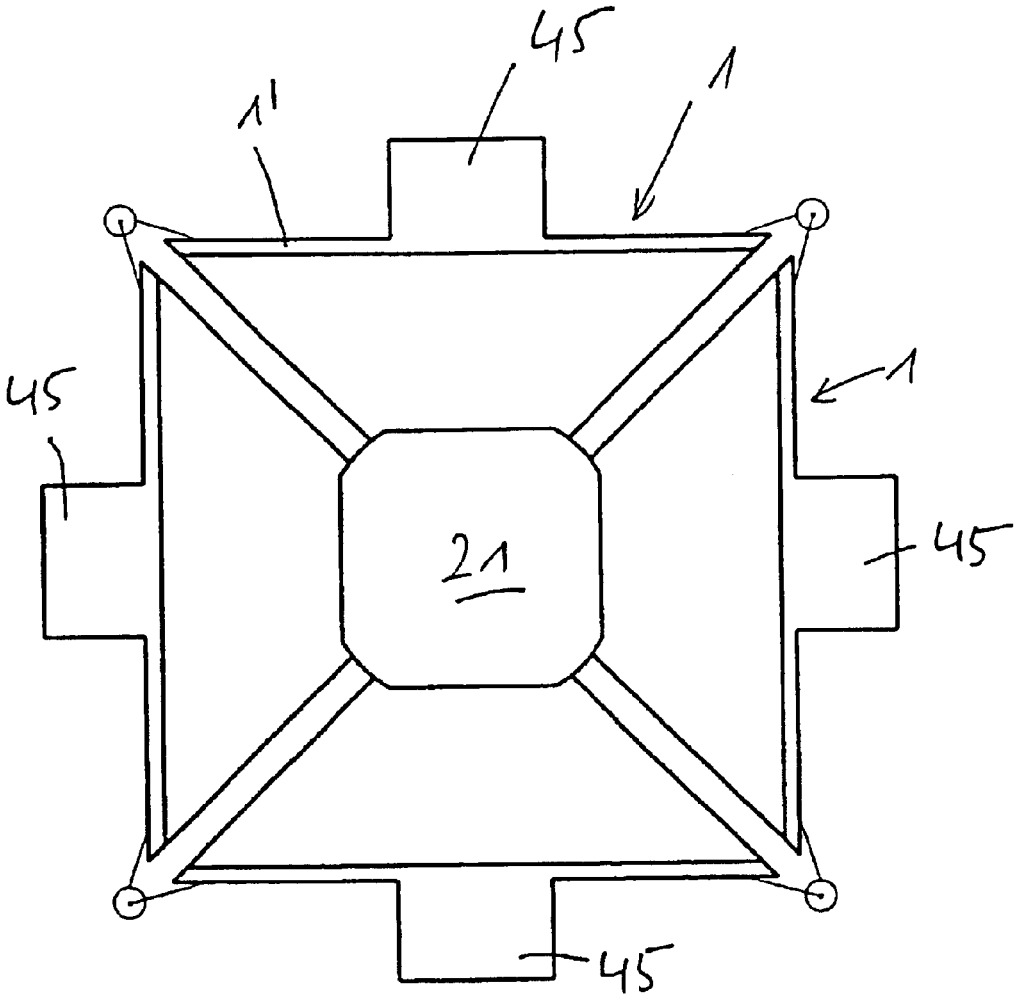
FIG. 10 shows a schematic plan view of another modified exemplary non-limiting illustrative implementation, with antenna element attachments at the side.

In addition, FIG. 10 will be used to explain how an improvement in the polar diagram characteristic can also be achieved by the capability to provide projecting lugs or attachments 45, which are electrically conductively connected and project such that they run outward preferably centrally and aligned parallel to the reflector 5, on the antenna element devices 1, which may be in the form of rods, or in the case of surface elements 39 on the corresponding boundary edges 1' which form the actual antenna element devices 1.

Figure 12:
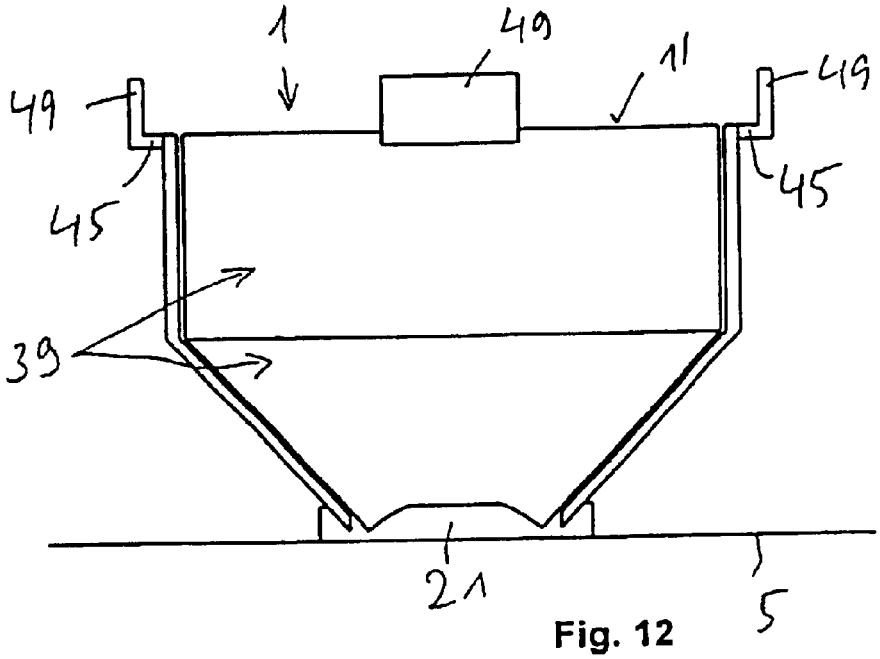
FIG. 12 shows a side view of an exemplary non-limiting illustrative implementation shown in FIG. 11.
Figure 11:
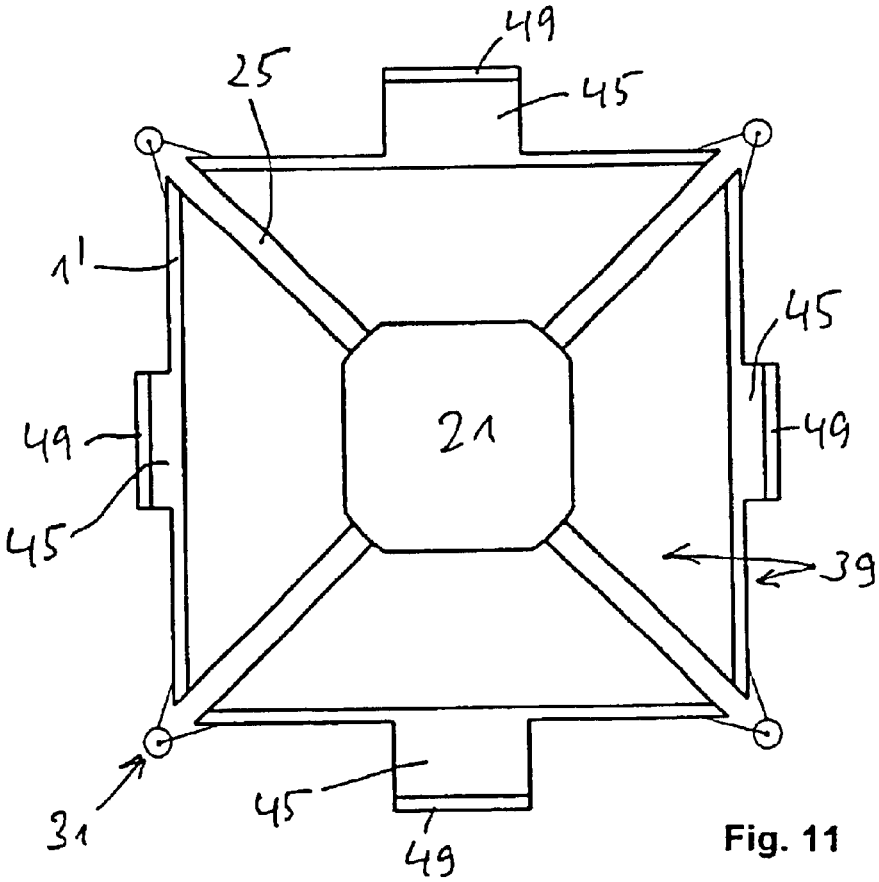
FIG. 11 shows a plan view of a further development of an exemplary non-limiting illustrative implementation shown in FIG. 10, with protruding projections running at right angles to the extension attachments.

In the exemplary non-limiting illustrative implementations shown in FIGS. 11 and 12, a further extension 49 is also provided at the outer ends 47 of these lugs or attachments 45 and, in this exemplary implementation, is once again preferably aligned vertically with respect to the reflector plane 3. In this case, the plan view in FIG. 11 also shows that the lugs or attachments 45, which are each located in pairs with an offset of 90° between them and preferably run parallel to the reflector plane 3, may run with a different longitudinal extent along the reflector plane. The same also applies to the extension attachments 49 which are preferably provided vertically with respect to the reflector plane 3.

A dual-polarized antenna has therefore been described with reference to the explained exemplary implementations, that is to say an antenna element arrangement which operates in one frequency band and in this case may have wide 3 dB beam widths of, for example, around 90°.

In this case, for example, two or more such antenna element arrangements, as explained with reference to FIGS. 1 to 11, may be arranged vertically one above the other, preferably in front of a common reflector 3. If the antenna element devices 1 or boundary edges 1' which have been mentioned are arranged horizontally and/or vertically with respect to one another in a corresponding manner to the exemplary non-limiting illustrative arrangements which have been explained, then this results in an X-polarized antenna, in which one polarization is aligned at +45° to the horizontal plane, and the other polarization is aligned at −45° to the horizontal plane. Thus, in a plan view, the polarization directions match the profile of the slots or gaps 25.

However, in an extended antenna structure, it is now possible to construct an entire antenna arrangement which is also suitable for operation in two frequency bands or frequency ranges, which are separated from one another and, for example, differ by a factor of 2:1. Thus, in other words, it is possible to construct an antenna which, for example, can be operated in a 900 MHz frequency band and in an 1800 MHz frequency band or, for example, in a 900 MHz frequency band and in a 2000 MHz or 2100 MHz frequency band.

Figure 13:
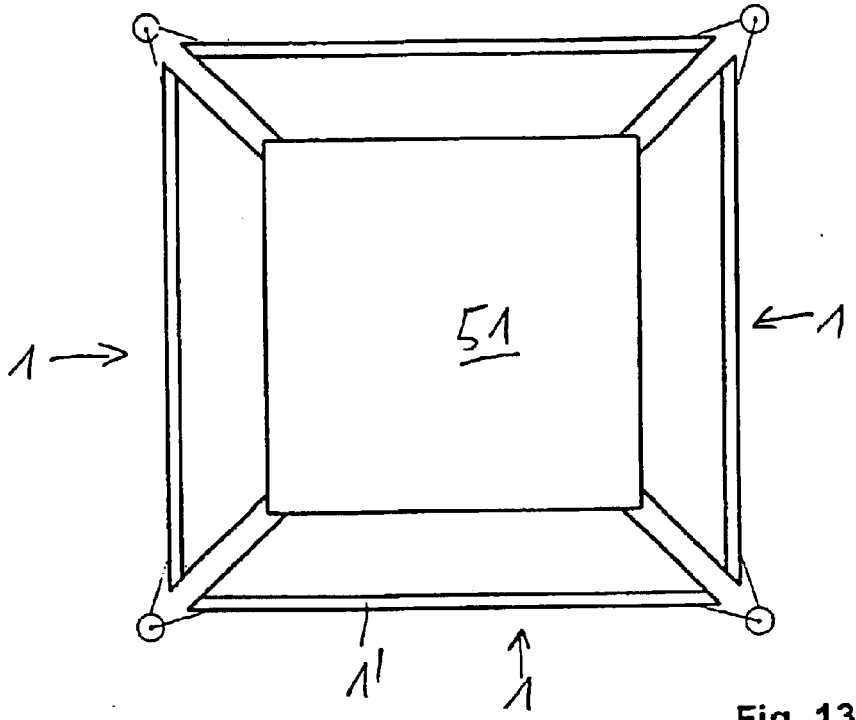
FIG. 13 shows a schematic plan view of an exemplary non-limiting illustrative dual-polarized two-band antenna element arrangement with an internal patch antenna element for the higher frequency.
Figure 14:
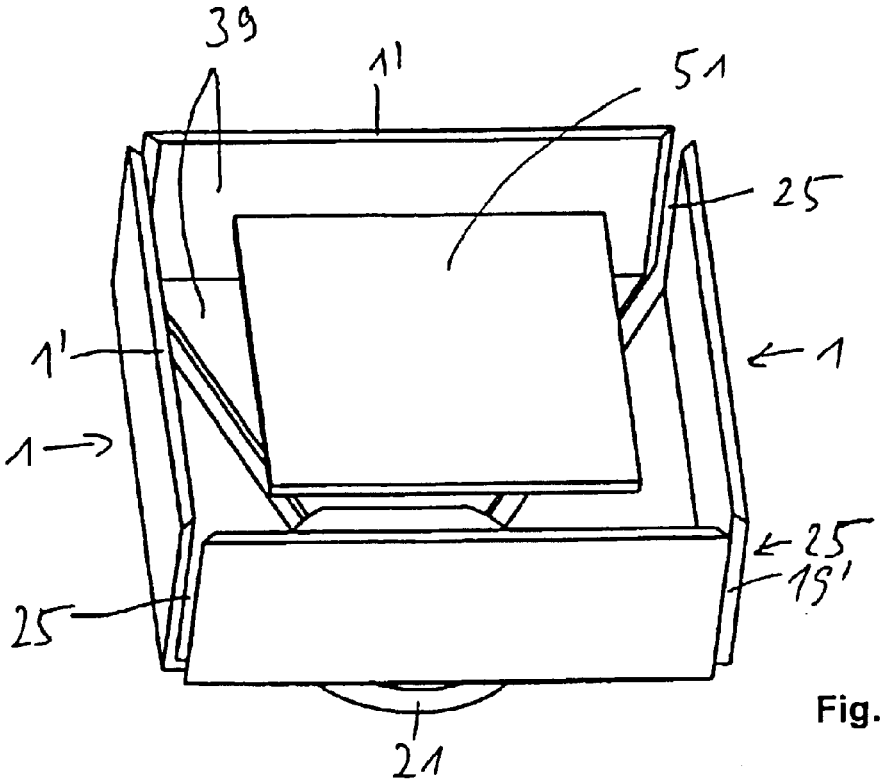
FIG. 14 shows a perspective illustration of the exemplary non-limiting illustrative antenna element arrangement shown in FIG. 13.

The exemplary non-limiting illustrative arrangements shown in FIGS. 13 and 14 illustrates a further antenna element arrangement for operation at a higher frequency band being provided in the interior of the dual-polarized antenna element arrangement that has been explained with reference to FIGS. 1 to 11.

In the exemplary non-limiting illustrative arrangements shown in FIGS. 13 and 14, this is provided by a patch antenna 51 which, in a plan view, has a square structure by way of example and, in this case, may be located at approximately the same height as the boundary edges 1', that is to say at the same height as the antenna element devices 1.

Figure 15:
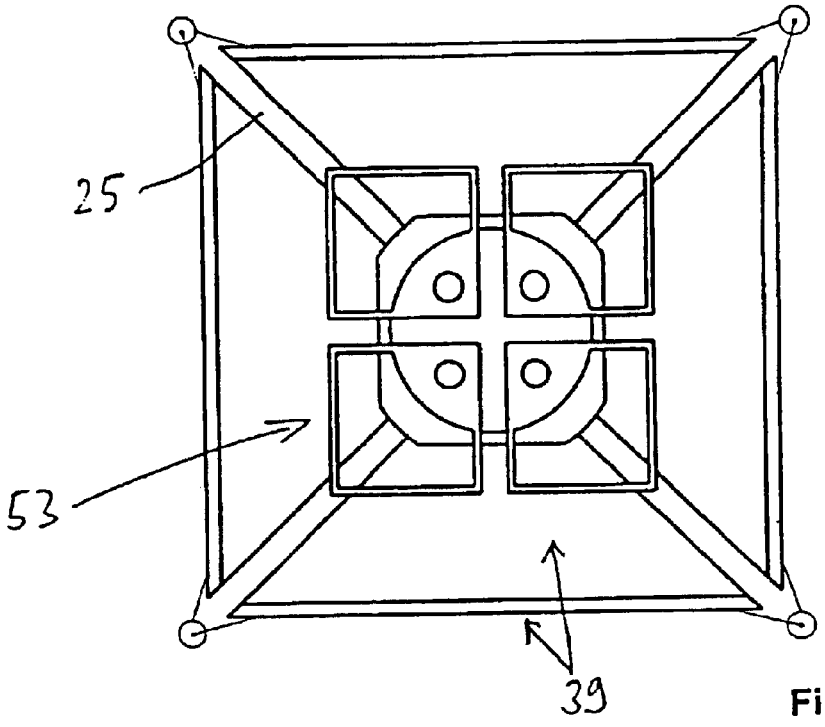
FIG. 15 shows a schematic plan view of an antenna element arrangement that has been modified from that in FIG. 13.
Figure 16:
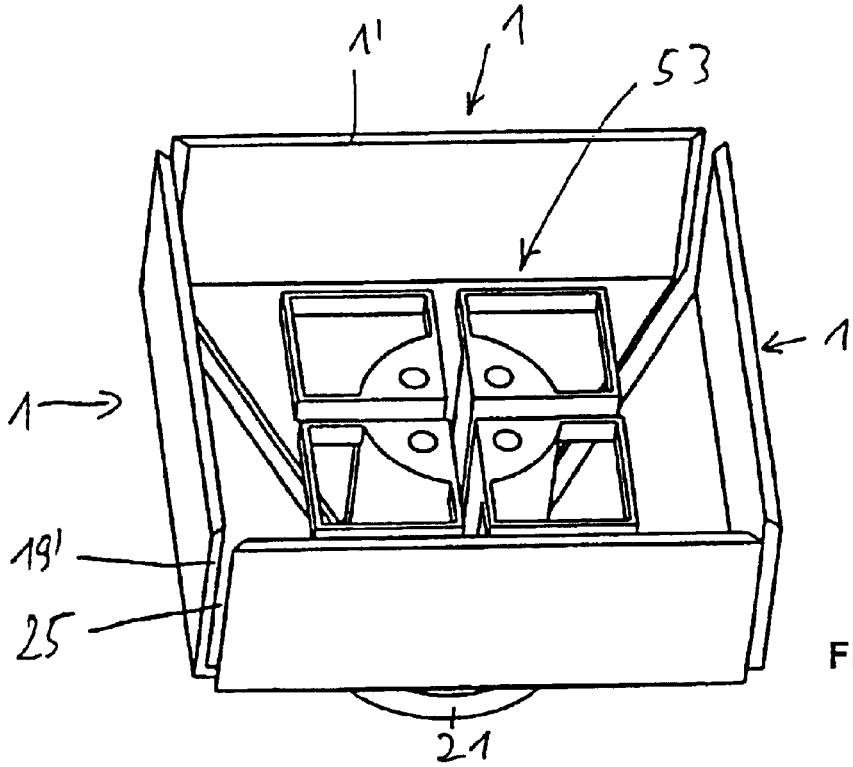
FIG. 16 shows a schematic perspective illustration of the exemplary arrangement shown in FIG. 15.

In the exemplary non-limiting illustrative arrangements shown in FIGS. 15 and 16, a vector dipole arrangement 53 is used for operation in the higher frequency band, as is in principle known from DE 198 60 121 A1, whose entire disclosure content is referred to and is included in the content of this application. In this vector dipole element 53, the dipole halves are each physically formed from two half dipole components aligned at right angles to one another, with the ends of the cables which lead to the respective dipole halves and are symmetrical or are essentially or approximately symmetrical being connected such that the corresponding cable halves of the adjacent dipole halves which are at right angles to one another are always electrically connected. The respectively diametrically opposite dipole halves are electrically fed for a first polarization, and are decoupled from a mutually orthogonal second polarization. The inner antenna element as shown in FIGS. 15 and 16 in the form of a vector dipole 53 as has been explained is thus also suitable for transmitting or receiving X-aligned polarizations, that is to say a +45° and −45° with respect to the aligned polarizations. In other words, the polarization of the inner vector dipole 53 and of the outer antenna element, which is designed to be wedge-shaped from bottom to top, are parallel.

While the technology herein has been described in connection with exemplary illustrative non-limiting implementations, the invention is not to be limited by the disclosure. For example, in contrast to the exemplary arrangements which have already been explained, other combinations of antenna element types are, of course, also feasible, for example cruciform dipoles, which may be used for the purposes of the invention. The invention is intended to be defined by the claims and to cover all corresponding and equivalent arrangements whether or not specifically disclosed herein.

What is claimed is:

1. A dual-polarized antenna element arrangement having a reflector and further comprising:

at least four conductive antenna element devices arranged offset through at least approximately 90° with respect to one another, the at least four conductive antenna element devices being mounted with respect to the reflector;

the four antenna element devices each having opposite antenna ends and each having a conductive structure between their opposite antenna element ends, said antenna element ends of two adjacent antenna element devices which are disposed adjacent to one another being isolated from one another for radio frequency purposes, pairs of said antenna element ends disposed adjacent to one another forming feed points, the antenna element devices being fed between respective opposite feed points at least approximately in phase and approximately symmetrically.

2. A dual-polarized antenna element arrangement, as claimed in claim 1 wherein the antenna element arrangement operates in a radio frequency band, and wherein:

the antenna element device in plan view are located offset through approximately 90° in the circumferential direction with respect to one another and form gaps therebetween, the gaps each have a feed point at a point located remotely from the reflector and isolated for radio frequency purposes, the maximum distance, projected onto the reflector, between in each case two opposite antenna element devices being at least equal to ¼ of the wavelength of the operating frequency band, and the antenna elements have feed points at which the antenna elements are fed at least approximately in phase with the feed points being formed by those adjacent antenna element ends which are adjacent to one another in pairs.

3. The dual-polarized antenna element arrangement as in claim 1, further including an electrically conductive holder for each element and wherein the antenna element devices are each held and/or mounted by means of the electrically conductive holder with respect to the reflector, a gap, which runs from the reflector to the feed point being formed between the electrically conductive holder of one antenna element device and the holding device of an adjacent antenna element device.

4. The dual-polarized antenna element arrangement as in claim 3, wherein the holder for the antenna element device is also formed from at least two rod devices, with the at least two rod devices originating from the respective antenna element end of the antenna element device, and leading to a point at a reflector-side end.

5. The dual-polarized antenna element arrangement as in claim 1, wherein the gaps between two adjacent holding devices or rod devices have at least approximately the same width over the entire length thereof.

6. The dual-polarized antenna element arrangement as in claim 1, wherein the element arrangement has an operating wavelength, and wherein the length of the gaps correspond to approximately ¼ of the operating wavelength.

7. The dual-polarized antenna element arrangement as in claim 1, further including a holding device for each of the antenna element devices, gaps being formed between the holding devices, the gaps being short-circuited on the side thereof facing the reflector.

8. The dual-polarized antenna element arrangement as in claim 1, wherein the length of the individual antenna element devices corresponds to approximately 0.2 times the wavelength to the wavelength itself at a mid-operating frequency of the dual-polarized antenna element arrangement.

9. The dual-polarized antenna element arrangement as in claim 1, further including rod devices which originate from the opposite antenna element ends and a connecting element which is provided on the side facing the reflector, and wherein the antenna element devices and the rod devices which originate from the opposite antenna element ends, and the connecting element which is provided on the reflector side are in the form of a free surface.

10. The dual-polarized antenna element arrangement as in claim 9, wherein the antenna element devices and the rod devices which originate from the opposite antenna element ends, and the connecting element which is provided on the side facing the reflector, or the boundary plane are designed to be conductive over the entire area thereof.

11. The dual-polarized antenna element arrangement as in claim 10, wherein the antenna element device includes a supporting holding device as an element thereof, the supporting holding device defining a large number of apertures therethrough, in the form of a grid.

12. The dual-polarized antenna element arrangement as in claim 1, further including a holding device in the form of rod devices designed to run in a straight line in a vertical sectional illustration, as an electrical element which is closed over at least part of the area thereof.

13. The dual-polarized antenna element arrangement as in claim 1, further including a holding device in the form of rod devices designed to be kinked or curved, such that to change a direction profile, in a vertical sectional illustration as an electrical element which is closed over at least part of the area thereof.

14. The dual-polarized antenna element arrangement as in claim 13, wherein the holding device has a section which is located closer to the reflector, said section being is aligned such that, in a vertical sectional illustration, it runs in an angle range from 20° to 70° diverging outward over the reflector.

15. The dual-polarized antenna element arrangement as in claim 13, wherein at least one section of the holding device which is on the outside and is located further away from the reflector runs such that it is aligned at least approximately vertically with respect to the reflector.

16. The dual-polarized antenna element arrangement as in claim 1, wherein the antenna element devices are designed to have an at least approximately square plan view.

17. The dual-polarized antenna element arrangement as in claim 1, wherein the antenna element devices have an at least approximately convex overall plan view.

18. The dual-polarized antenna element arrangement as in claim 1, wherein the antenna element devices have a concave-shaped plan view.

19. The dual-polarized antenna element arrangement as in claim 1, further including attachments or lugs, which project outward in pairs opposite one another, formed on the antenna element devices.

20. The dual-polarized antenna element arrangement as in claim 19, further including lengthening attachments formed on the attachments or lugs which project outward, pointing away from the reflector.

21. The dual-polarized antenna element arrangement as in claim 1, wherein the antenna element arrangement has a cup-shaped structure.

22. The dual-polarized antenna element arrangement as in claim 1, further including a further antenna element arrangement for operation in a further frequency band arranged in the interior of the antenna element arrangement in a plan view.

23. The dual-polarized antenna element arrangement as in claim 22, wherein the further antenna element arrangement for operation in the further frequency band is in the form of a patch antenna element.

24. The dual-polarized antenna elements arrangement as in claim 22, wherein the further antenna element arrangement for operation in the further frequency band is in the form of a cruciform dipole.

25. The dual-polarized antenna element arrangement as in claim 22, wherein the further antenna element arrangement for operation in the further frequency band is in the form of a dipole square.

26. The dual-polarized antenna element arrangement as in claim 22, wherein the further antenna element arrangement for operation in the further frequency band is in the form of a vector dipole.

27. The dual-polarized antenna element arrangement as in claim 1, wherein two opposite feed points are connected together via a coaxial line of at least approximately the same length to form a central feed point, with the one set of opposite feed points connected together in pairs being used to feed one polarization, and the two further feed points which are connected together and are offset through 90° with respect to the first being used to feed the respective other polarization.

28. The dual-polarized antenna element arrangement as in claim 1, wherein four antenna element devices are provided and, in a plan view, are arranged at least approximately symmetrically about a center point.

29. The dual-polarized antenna element arrangement as in claim 1, wherein the dual-polarized antenna element arrangement has a wavelength λ of the operating frequency band, and wherein the maximum distance between in each case two opposite antenna element arrangements is less than or equal to the wavelength λ of the operating frequency band.

30. The dual-polarized antenna element arrangement as in claim 1, wherein the dual-polarized antenna element arrangement has a wavelength λ of the operating frequency band, and wherein the length of the antenna element devices is less than or equal to the wavelength λ of the operating frequency band.

31. A dual polarized antenna element arrangement comprising:

at least four conductive antenna elements angularly displaced substantially at right angles from one another, each said element providing opposite ends; and a conductive structure for each said element, said conductive structures electrically coupling said opposite ends of a respective element together, said adjacent ends of adjacent ones of said elements being RF-isolated from one another, adjacent ends of adjacent ones of said at least four conductive antenna elements forming substantially symmetrical in-phase RF feed points for said antenna element arrangement.

* * * * *